United States Patent [19]

Knappe et al.

[11] 3,962,758

[45] June 15, 1976

[54] CLIP FOR RETAINING A SHIRT OR SIMILAR ARTICLE OF CLOTHING IN FOLDED POSITION ON AN INSERT

[75] Inventors: Heinrich Knappe, Eidinghausen; Karl Heinz Nolte, Vlotho; Reinhold Kempelmann, Bad Salzuflen, all of Germany

[73] Assignee: Herbert Kannegiesser Kommanditgesellschaft, Vlotho, Germany

[22] Filed: Nov. 5, 1974

[21] Appl. No.: 521,017

[30] Foreign Application Priority Data

Nov. 10, 1973 Germany ..... 2356262

[52] U.S. Cl. ..... 24/255 GP; 223/71; 24/138 R

[51] Int. Cl.[2] ..... A44B 21/00

[58] Field of Search..... 24/255 GP, 138 R, 138 A, 24/137 R, 137 A; D7/198; 223/37, 71

[56] References Cited

UNITED STATES PATENTS

| | | | |
|---|---|---|---|
| 184,846 | 11/1876 | Cummings | 24/138 R |
| 2,170,204 | 8/1939 | Lemoine | 24/138 R |
| 2,310,156 | 2/1943 | Van Der Clute | 24/255 GP |
| 2,433,171 | 12/1947 | Tegarty | 24/138 R |
| 3,462,809 | 8/1969 | Froehlich | 24/255 GP |

*Primary Examiner*—G.V. Larkin
*Attorney, Agent, or Firm*—Sughrue, Rothwell, Mion, Zinn & Macpeak

[57] ABSTRACT

A clip for retaining shirts or similar articles of clothing in a folded position about an insert is disclosed, wherein the clip has a general "U" shape with two arms connected by a yoke portion. The inner sides of the arms closest together are denticulated to grip material inserted therebetween. The ends of the arms are bent outwardly so as to extend in an outward direction as far as the outermost faces of the remaining portion of the arms.

2 Claims, 8 Drawing Figures

CLIP FOR RETAINING A SHIRT OR SIMILAR ARTICLE OF CLOTHING IN FOLDED POSITION ON AN INSERT

BACKGROUND OF THE INVENTION

1. Field of the Invention

The present invention relates to a process and apparatus for folding shirts or similar articles of clothing for packing for use in conjunction with an apparatus wherein a plurality of folding devices are adapted to rotate in synchronism and each shirt or similar article of clothing placed on these folding devices is folded in the course of its step-by-step processing about a cardboard insert and fastened so that it does not come apart.

2. Description of the Prior Art

In the above-mentioned known process, a shirt or similar article of clothing is folded about a cardboard insert and is manually fastened so that it does not fall apart by means of pins and U-shaped clips. The shoulder and sleeve sections of the shirt or similar article of clothing, in particular, are pinned and only the side and sleeve sections of the article are fastened by means of clips, the U-shaped clips being pushed from the longitudinal side of the cardboard insert onto the shirt or similar article of clothing, with the cardboard inserted therebetween.

Mechanical pinning and clipping of a shirt or similar article of clothing in the above manner about a cardboard insert is, for various reasons, either not possible or not advantageous within the framework of the process mentioned initially. In addition, the means employed according to the known process such as cardboard inserts, pins and U-shaped clips are unsuitable or disadvantageous for mechanically fastening articles of clothing so that they do not fall apart. For example, it is impossible to supply the pins and insert them in the shirt or similar article of clothing at the spot at which the article is to be fastened by means of mechanical devices and the U-shaped clips can only be mechanically pushed onto the shirt or similar article of clothing with great difficulty.

The above-mentioned U-shaped clips for the manual clipping operation possess two arms of different lengths exerting a clamping action by their inherent tension. The end of the shorter arm is outwardly bent upwards and the inner sides of the arms are provided with undulating projections in the region where they are closest to each other. These U-shaped clips are made of plastic material and have a transparent appearance. The clips are accordingly translucent. They also possess the same width over their entire length. A clip of this type is disclosed in U.S. Pat. No. 3,462,809.

In German OS 2 153 157, a U-shaped clip is described which is not only suitable for manual operations but also for mechanical fastening operations. This clip possesses two arms of equal length and exerts a clamping action between the two arms. The ends of the arms are outwardly bent upwards to such an extent that the outer edges of the same lie in the same plane as the outer faces of the remaining arm parts coordinated therewith, the aforementioned planes being arranged in parallel. The upwardly bent ends of the arms are substantially broader than the remaining parts of the arms. In addition, the inner sides of the arms are denticulated in the region where they are closest together. The clips are made of plastic material. A particular disadvantage of mechanically pushing this U-shaped clip onto a folded shirt or similar article of clothing is that the upwardly bent ends of the arms are substantially broader than the remaining parts of the arms so that it is difficult to mechanically guide the same to the spot to be clipped and this can only be effected by means of complicated devices. This constitutes the reason why these U-shaped clips and the devices described in the above-mentioned German Offenlegungsschrift (delivery unit and guide track) have not yet been used in practice.

German Gebrauchsmuster 1 811 063 describes a clip belonging to the U-shaped clip group which is designed for hanging laundered clothing on washing lines. The inner sides of the arms of this clip have interlocking teeth obliquely directed towards the rear part of the same. However, on account of its shape, this clip is otherwise unsuitable for clipping shirts or similar articles of clothing which have just been manufactured.

It is also known to provide holes of varying shapes and sizes at various points in the above-mentioned cardboard inserts. This is done for various reasons and makes it possible, inter alia, to manually pin by means of pins the folded shirt or similar article of clothing to prevent it from coming apart.

The known cardboard inserts also have the disadvantage that they can only be mechanically lifted with difficulty piece by piece from a stack consisting of a plurality of cardboard inserts, more particularly, by means of so-called suction cups, and thereafter conveyed to the folding devices owing to the fact that the cardboard inserts in the pile tend to stick together as a result of being stacked on top of one another.

SUMMARY OF THE INVENTION

The object of the present invention is to provide a process and means in the form of a cardboard insert and a U-shaped clip with which it is possible, within the framework of the basic process mentioned initially, to fasten shirts or similar articles of clothing in a more advantageous manner than hitherto, more particularly, mechanically, and to fasten them in an especially advantageous manner so that they do not come apart.

The proposed cardboard insert should also be constructed in such a way that it can be raised from a stack by means of a suction cup device without one or more additional cardboard inserts being raised at the same time.

The U-shaped clip to be proposed should also be designed in such a way that photoelectric sensing devices, for example, photocells are actuated when they pass by the same.

The process according to the invention is characterized in that the shirt to be folded about the cardboard insert is secured against coming apart on the collar side of the same by the mechanical insertion of clips on the part of the same resting on the rear side of the cardboard insert.

By means of this process it is possible to fasten together a shirt or similar article of clothing in the course of step-by-step folding operations in a more advantageous manner than hitherto, namely mechanically, and in an especially advantageous form. This is especially advantageous, inter alia, because by fastening the article on the end where the collar is located, the mechanical expenditure required for this process and the control problems associated therewith are relatively minor. In addition, it is substantially easier to mechanically push clips into place than to mechanically insert pins — if this is even possible.

It is also advantageous if one of the clips is pushed onto the article in such a way that the two lengthwise folded lateral shoulder parts of the shirt in the region of the sleeve connections are fastened by clips with the cardboard inserted therebetween, preferably after the shirt has been folded lengthwise but still has to be folded crosswise, and if two clips are inserted in such a way that the two lengthwise folded lateral shoulder parts of the shirt and the lengthwise and crosswise folded lower part of the same located in the region of the shoulder parts are fastened without including the cardboard insert.

These developments of the process according to the invention are advantageous, inter alia., because the part of the folded shirt or similar article of clothing which rests on the rear side of the cardboard insert, more particularly, the part of the article of clothing located in the upper region of the cardboard insert, is fastened using a minimum of clips and at an advantageous point during the process.

It is also advantageous for the cardboard insert to possess a hole in the region in which the shirt is fastened by means of a clip with the cardboard inserted therebetween. The hole in the cardboard insert is preferably round in shape and has a diameter of approximately 30–35 mm. This is an advantage because it enables the part of the folded shirt or similar article of clothing located in the central part of the cardboard insert, for example, the lateral shoulder parts of the same, to be fastened by clips with the cardboard inserted therebetween.

It is also advantageous if a plurality of smaller holes are uniformly distributed over the remaining part of the cardboard insert. Preferably about 10 round holes having a diameter of approximately 8–10 mm are provided. This is advantageous because it enables stacked cardboard inserts to be supplied individually to the folding devices by so-called suction cups in a reliable manner. By providing both the smaller holes and the larger hole or holes for the insertion of the clips with the cardboard inserted therebetween, air can immediately penetrate between a cardboard insert and the insert located beneath it when the first insert is raised, thereby preventing the insert located beneath it from being removed at the same time.

It is also an advantage to use a U-shaped clip which is characterized by the combination of the following features: two arms of equal length exerting a clamping action by their inherent tension and the ends of which are outwardly bent upwards to such an extent that the outer edges of the same are located in the same plane as the outer surfaces of the remaining arm parts coordinated therewith, the planes are located parallel to one another, the inner sides of the arms are denticulated in the region in which they are closest to one another, the clips are uniformly broad over their entire length, preferably being 6.5 mm in breadth. This form of U-shaped clip is especially advantageous because these clips can be mechanically supplied to the parts of the shirt or similar article of clothing to be fastened and can be pushed onto these parts by means of relatively simple devices. Thus, it is possible, using a cavity resonator operating by the micro projecting process, firstly to insert the clips in series into commercially available rectangular tubes, secondly to push the clips being conveyed to the parts to be clipped in the aforementioned rectangular tubes onto the parts of the article to be fastened by the clips by means of simple and relatively reliable devices, for example, pneumatic working cylinders.

It is also advantageous if the aforementioned U-shaped clips are made of opaque plastic. This is an advantage, firstly because it enables the clips to be manufactured economically and secondly because the movement of the clip or plurality of clips being supplied in the aforementioned rectangular tubes can be monitored by means of simple and relatively reliable devices, namely by means of photoelectric sensing elements.

It is also advantageous for the clips to be constructed in such a way that the denticulations on the inner side of the arms are in the form of saw teeth, the tips of the teeth being directed towards the rear inner part of the clip. This constitutes an advantage firstly because this allows the clips to be pushed easily onto the parts of the article to be fastened and secondly because it renders the clips difficult to remove and, in particular, it prevents the clips from springing back if it is exerting a relatively powerful fastening tension.

Other objects, features and advantages of the process according to the invention and the means for effecting the same will be made apparent from the following description of preferred embodiments thereof provided with reference to the accompanying drawings.

The reference numbers designate the following:

| | |
|---|---|
| 10-1 | = shirt (folded and prepared for packing) |
| 100 | = cardboard insert |
| 101 | = clip (U-shaped) |
| 102 | = hole in 100 (for fastening 10-1 with 100 inserted therebetween) |
| 103 | = hole in 100 |
| 104 | = arm of 101 |
| 105 | = end of 104 |
| 106 | = outer edge of 105 |
| 108 | = outer face of 104 |
| 109 | = inner side of 104 |
| 110 | = denticulation of 109 |
| 111 | = rear inner part of 101 |
| 112 | = rectangular tube |
| 113 | = photoelectric sensing element |
| 114 | = transmitter of 113 |
| 115 | = receiver of 114 |
| 116 | = light beam of 113 |
| 117 | = hole in 112 |
| 118 | = yoke of 101 |
| 119 | = outer face of 118 |
| 120 – 123 | = planes |

-continued 124, 125 = sides of 101.

DESCRIPTION OF THE PREFERRED EMBODIMENTS

Figure 1:
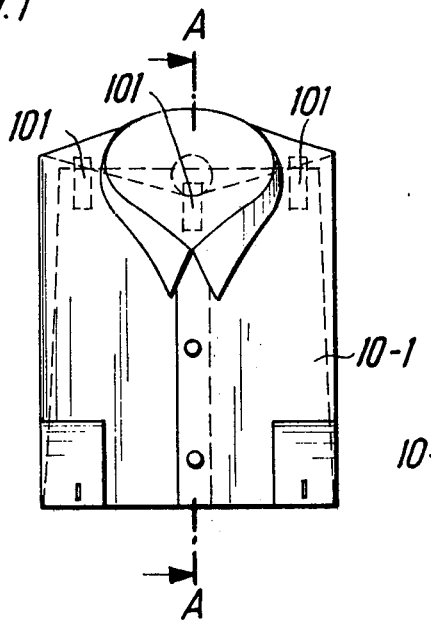
FIG. 1 shows a front view of a shirt folded about a cardboard insert and fastened according to the invention.
Figure 2:
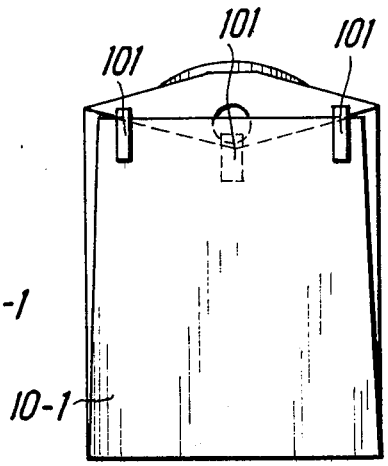
FIG. 2 shows a rear view of FIG. 1.
Figure 3:
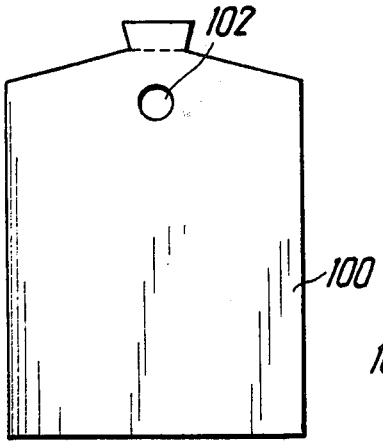
FIG. 3 shows a cardboard insert comprising a hole for fastening the two lateral shoulder parts of a shirt in the region of the sleeve connections with the cardboard inserted therebetween.

FIGS. 1 and 2 show shirt 10-1 folded about the cardboard insert 100 and fastened according to the invention to prevent it from coming apart, namely by the mechanical insertion of clips 101 onto the part of the shirt located on the rear side of the cardboard insert 100. FIG. 3 shows the shape of the cardboard insert 100 about which the shirt 10-1 represented in FIGS. 1 and 2 is folded and prepared for packing.

Figure 5:
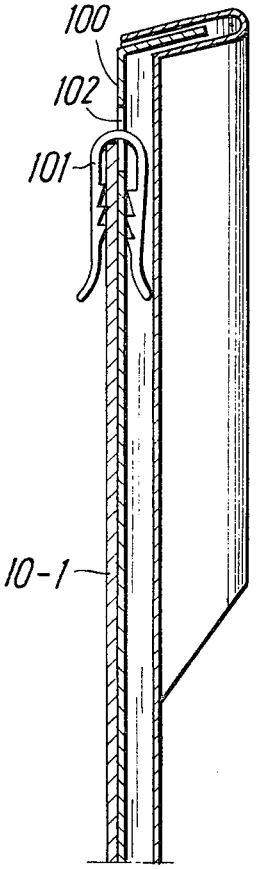
FIG. 5 is an enlarged view of a section along the line A—A in FIG. 1.

FIG. 5 shows how the shoulder parts of the shirt 10-1 are held by clips in the region of the sleeve connections with the cardboard 100 inserted therebetween.

FIGS. 1, 2, 3 and 5 also show the position of the hole 102 in the cardboard insert 100. This hole is provided so that the shoulder parts of the shirt 10-1 can be fastened by means of clips in the region of the sleeve connections with the cardboard 100 inserted therebetween. The lower edge of the hole 102 which is approximately 30–35 mm in diameter is arranged generally at the point of intersection of the folded shoulder sections, but preferably about 5 mm below this intersection point.

Figure 4:
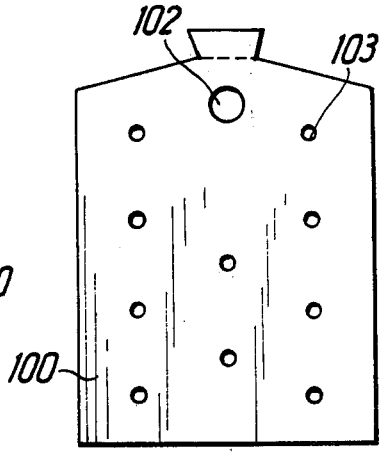
FIG. 4 shows a cardboard insert as disclosed in FIG. 3 comprising additional uniformly distributed smaller holes.

FIG. 4 shows a cardboard insert 100 such as the one shown in FIG. 3 but which is provided with additional uniformly distributed small holes 103 which are necessary to enable stacked cardboard inserts 100 to be supplied individually to folding devices which are not represented by means of suction cups which are also not represented. The 10 holes 103 which are shown are approximately 8–10 mm in diameter.

Figure 6:
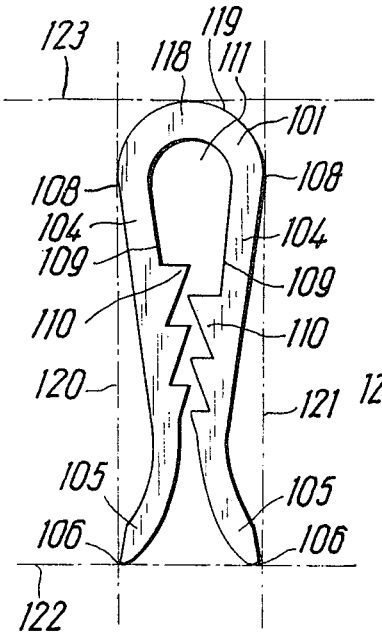
FIG. 6 is an enlarged view of the U-shaped clip shown in FIGS. 1, 2 and 5.
Figure 7:
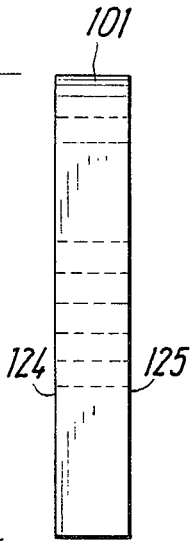
FIG. 7 is a side view of FIG. 6.

The U-shaped clip 101 which is represented on an enlarged scale in FIGS. 6 and 7 has two arms 104 of equal length which exert a clamping action by their inherent tension. The ends 105 of the arms are outwardly bent upwards to such an extent that the outer edges 106 of the same are located in the same planes 120, 121 as the outer faces 108 of the remaining arm parts coordinated therewith; the two planes 120, 121 being parallel to each other. The outer edges 106 of the upwardly bent ends 105 also lie in a plane 122 which is at right angles to the two parallel planes 120, 121 and parallel to a plane 123 against which the outer face 119 of the yoke 118 abuts.

The inner sides 109 of the arms 104 of the clips 101 bear saw teeth in the region in which they are closest to each other such that the tips of the denticulations 110 are directed towards the rear inner part 111 of the clip 101.

Owing to the fact that the planes 120, 121 or 122, 123 at the outer edges or faces of the U-shaped clip 101 represented in FIGS. 6 and 7 are parallel and at right angles to one another and that the sides 124, 125 of the same are parallel to one another and at right angles to the planes 120–123, the clip 101 can be conveyed in commercially available rectangular tubes or the like in series and/or on top of one another. The term transportable in series means, for example, that the clips can also be transported in a single-sided, partially open, rectangular tube 112 (FIG. 8).

Figure 8:
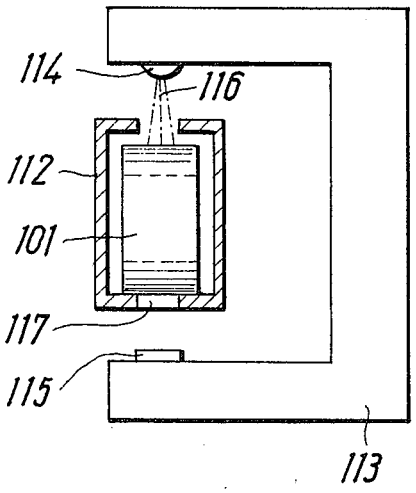
FIG. 8 shows a device for supplying the U-shaped clips represented in the preceding figures.

FIG. 8 also shows how the movement of the clip and/or plurality of clips being transported in the rectangular tube 112 can be monitored by a photoelectric sensing element 113 consisting of a transmitter 114 and a receiver 115.

As the rectangular tube 112 is only partially open on the upper side, a hole has been made in the wall of the lower iside of the same so that if there are no clips 101 in the rectangular tube, the light beam 116 from the transmitter 114 passes to the receiver 115. It is a prerequisite for this advantageous method of monitoring the process that the clips 101 are impervious to light.

Thus, the U-shaped clip 101 according to the invention not only makes it possible to mechanically fasten the folded shirt 10-1 so that it does not come apart using relatively simple devices but it also enables reliable mechanical controlling of these devices if it is made of material which is impervious to light.

What is claimed is:

1. A generally U-shaped clip for use with an automatic feeding device which feeds the clip into an automatic shirt folding apparatus for retaining shirts or similar articles of clothing in position about an insert, comprising:

a. a generally U-shaped yoke (118) having a constant width and thickness;

b. two arms (104) of equal length each having one end attached to said yoke, said arms having the same width and thickness as said yoke (118), the arms converging toward each other to an area of minimum separation distance whereupon the distal ends of said arms (106) are bent outwardly away from the longitudinal axis of said clip and each end in a plane (120, 121) parallel to the longitudinal axis of the clip and containing the outermost portion of said yoke (118); and c. denticulations (110) located on the inner surface (109) of each of said arms at the area of minimum separation (104) to grip the shirt or similar article of clothing therebetween, the denticulations having a saw-toothed formation wherein the tips of same are directed towards the yoke (118) of the clip (101).

2. A U-shaped clip according to claim 1, characterized in that the clip (101) is made of opaque plastic material.

* * * * *